US005370240A

United States Patent [19]

Hand

[11] Patent Number: 5,370,240

[45] Date of Patent: Dec. 6, 1994

[54] DUAL SHOOTERS BOW AND GUN STAND

[76] Inventor: Sidney D. Hand, R.D. #1, Box 63 C, Williamstown, N.Y. 13493

[21] Appl. No.: 103,976

[22] Filed: Aug. 9, 1993

[51] Int. Cl.[5] ..... A47F 7/00

[52] U.S. Cl. ..... 211/13; 211/60.1

[58] Field of Search ..... 211/13, 60.1, 62, 64

[56] References Cited

U.S. PATENT DOCUMENTS

| | | | |
|---|---|---|---|
| 4,450,967 | 5/1984 | Castro | 211/13 |
| 4,474,296 | 10/1984 | Hartman | 211/13 |
| 4,896,854 | 1/1990 | St. Laurent | 248/156 |
| 4,936,415 | 6/1990 | Williams | 182/187 |
| 5,048,504 | 9/1991 | Ballard | 124/86 |
| 5,085,319 | 2/1992 | Wellman et al. | 206/315.11 |

OTHER PUBLICATIONS

Gander Mountain Catalog, Archery '93, Gander Mountain Inc., 1993, (p. 49).

*Primary Examiner*—Ramon O. Ramirez
*Assistant Examiner*—Sarah L. Purol
*Attorney, Agent, or Firm*—Lawrence P. Trapani

[57] ABSTRACT

In accordance with the present invention, there is provided a stand for supporting sport weapons such as bows, firearms and the like. The inventive stand comprises a frame configured to be supported upright with respect to a surface. The frame includes a base which rests substantially flat on the surface. The frame further includes first and second upright members connected to the base. First and Second bracket members are mounted to the first and second upright members respectively on one side for pivotal rotation. The first and second bracket members have support members which project outwardly to one side of the frame and are substantially perpendicular thereto. Third and Fourth bracket members are mounted to the first and second upright members respectively on the other side for pivotal rotation. The third and fourth bracket members have support members which project outwardly to the other side of the frame and are substantially perpendicular thereto. The support members of the first and second bracket members provide a first pair of independently adjustable rest points for supporting a first sport weapon. The support members of the third and fourth bracket members provide a second pair of independently adjustable rest points for supporting a second sport weapon on the opposite side of the frame. Methods for supporting sport weapons, such as bows, firearms and the like, are also contemplated by the present invention.

20 Claims, 3 Drawing Sheets

DUAL SHOOTERS BOW AND GUN STAND

BACKGROUND OF THE INVENTION

1. Technical Field

The present invention relates generally to sports equipment and accessories for target shooters, marksman, archers and the like, and relates more particularly to a stand for supporting sport weapons such as bows, firearms and the like.

2. Background Art

Hunters, marksmen and archers who use bows and firearms often spend many hours practicing their sport on public or private practice ranges. Sometimes, these ranges are located in remote areas which would require one to hand-carry his or her equipment to the range. Most often, the weapons appearing on the range will have a wide variety of different physical dimensions and configurations. On the range, it is common that individuals will pair up and practice together. While practicing, it is often necessary to temporarily place the weapon down when not in use. In such case, if the weapon is not properly secured, it could be damaged, misaligned, misadjusted or subjected to excessive wear.

The need therefore arises for a device which can hold a sport weapon, while not in use, in such a manner as not to cause damage, misalignment, misadjustment or excessive wear to the weapon. In addition, this device should be adjustable to accommodate weapons of a variety of different dimensions and configurations. Further, the device should be able to hold two weapons to accommodate the common situation where two individuals are practicing together, or the case where one individual may bring two weapons onto the range. The device should be lightweight and portable for easy transportability to remote practice ranges. Further, the device should offer ergonomic features which facilitate access to the weapon and otherwise make the device convenient to use on the range.

Attempts have been made to fulfill some of the abovementioned requirements, but none has succeeded. For example, a bow stand is disclosed in U.S. Pat. No. 5,085,319 to Wellman et al. This stand suffers from a substantial drawback in that the bars employed for supporting the bow are fixed. Such a device is not optimum for supporting a wide variety of bow configurations across its fixed bars. In addition, the stand does not appear to be portable, lightweight, or easily transportable. Moreover, the support bars consist merely of square pieces of wood, the edges of which can cause unnecessary wear on the bow. Further, the device suffers from the lack of ergonomic features, most notably, the vertical arrow compartments require the user to reach over the support bars.

Another example is presented in U.S. Pat. No. 4,474,296 to Hartman. There, a portable archery stand has limited capacity in that it accommodates only a single bow. In addition, its support structure is limited in its adjustability to accommodate different bow configurations. Moreover, the bow is supported in a vertical position by two rigid bifurcated brackets which may cause unnecessary wear on the bow. Further, the stand in Hartman does not appear to be suitable other types of sport weapons, such as firearms.

SUMMARY OF THE INVENTION

It is therefore an object of the present invention to provide a stand for supporting sport weapons that avoids the problems associated with the prior art.

It is another object of the present invention to provide a sport weapon stand which is suitable for use on a practice range.

It is a further object of the present invention to provide a sport weapon stand which can support two weapons for convenient access by two individuals on the practice range.

It is yet another object of the present invention to provide a sport weapon stand which can support a weapon in such a manner as not to cause damage, misalignment, misadjustment or unnecessary wear to the weapon.

It is yet a further object of the present invention to provide a sport weapon stand having an adjustable support structure which accommodates a wide variety of weapon dimensions and configurations.

It is still another object of the present invention to provide a sport weapon stand which is lightweight and portable to facilitate its transportation to remote practice ranges.

It is still a further object of the present invention to provide a sport weapon stand which is capable of supporting ancillary sport equipment, in addition to weapons, and which facilitates access to such equipment.

These and other objects are attained in accordance with the present invention wherein there is provided a stand for supporting sport weapons such as bows, firearms and the like. The inventive stand comprises a frame configured to be supported upright with respect to a surface. The frame includes a base which rests substantially flat on the surface. The frame further includes first and second upright members connected to the base. The base may comprise first and second elongated base members, each having opposing ends which are turned downward to function as feet resting on the surface. In such an embodiment, the first and second upright members of the frame are connected to the first and second base members respectively.

Mounted to one side of the frame is a first support means for supporting a first sport weapon on a plurality of rest points. The first support means is adjustable to position the plurality of rest points at desired support locations. Mounted to the other side of the frame is a second support means for supporting a second sport weapon on a second plurality of rest points. The second support means is also adjustable to position the second plurality of rest points at desired support locations.

In the preferred embodiment, the first support means comprises first and second bracket members, each having a mounting arm and a support member. The mounting arms of the first and second bracket members are mounted to the first and second upright members respectively for pivotal rotation about respective pivot points. The support members of the first and second bracket members project outwardly to one side of the frame and are substantially perpendicular thereto.

The second support means comprises third and fourth bracket members, each having a mounting arm and a support member. The mounting arms of the third and fourth bracket members are mounted to the first and second upright members respectively for pivotal rotation about respective pivot points. The support members of the third and fourth bracket members project outwardly to the opposite side of the frame and are substantially perpendicular thereto.

The support members of the first and second bracket members provide a first pair of rest points for supporting a first sport weapon on the one side of said frame. The positions of the first pair of rest points are independently adjustable in accordance with the rotation of the mounting arms of the first and second brackets about their respective pivot points.

The support members of the third and fourth bracket members provide a second pair of rest points for supporting a second sport weapon on the opposite side of the frame. The positions of the second pair of rest points are independently adjustable in accordance with the rotation of the mounting arms of the third and fourth brackets about their respective pivot points.

Methods for supporting sport weapons, such as bows, firearms and the like, are also contemplated by the present invention. These methods comprise the steps of (1) supporting a frame in an upright position; (2) providing a first plurality of independently adjustable rest points, coupled to one side of the frame, to support a first sport weapon thereon; and (3) providing a second plurality of independently adjustable rest points, coupled to the opposite side of the frame, to support a second sport weapon thereon.

BRIEF DESCRIPTION OF THE DRAWINGS

Further objects of the present invention will become apparent from the following description of the preferred embodiment with reference to the accompanying drawing, in which.

DESCRIPTION OF THE PREFERRED EMBODIMENT

Figure 1:
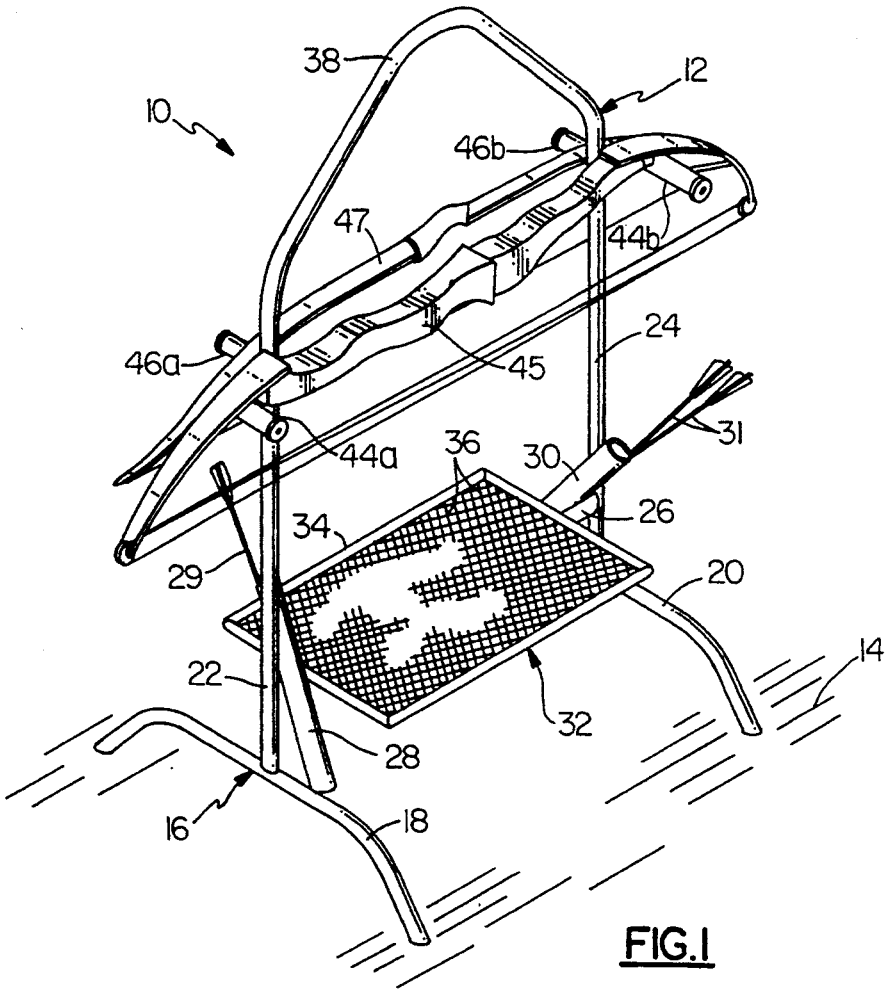
FIG. 1 is a perspective view of a sport weapon stand supporting two archery bows and holding a plurality of arrows, wherein said stand embodies the teachings of the present invention.

Referring to FIG. 1 of the drawing, there is shown, in a perspective view, a stand 10 for supporting sport weapons such as bows, firearms and like implements. A frame 12 is configured to be supported upright with respect to a surface 14. Frame 12 includes a base 16, having an elongated base member 18 and an elongated base member 20. Base members 18 and 20 each have opposing ends which are turned downward to form feet which rest directly on surface 14, as shown in FIG. 1.

Frame 12 further includes an upright member 22 and an upright member 24, which are connected to base member 18 and base member 20 respectively. A cross member 26 is situated between upright members 22 and 24, and is rigidly connected to upright member 22 at one end and to upright member 24 at an opposing end (See FIG. 1).

With further reference to FIG. 1, there is shown an arrow receptacle 28 shaped like a bow quiver. Receptacle 28 is connected to frame 12 at three points. The cylindrical body of receptacle 28 is connected to upright member 22 at one point, and to cross member 26 at another point. In addition, the bottom portion of receptacle 28 is connected to base member 18 at the third point. Receptacle 28 contains an opening through which arrows are inserted for storage in the receptacle. As shown in FIG. 1, an arrow 29 is stored in receptacle 28. Receptacle 28 is inclined, with one orientation, relative to upright member 22, such that its opening substantially faces to the far side of frame 12 (See FIGS. 1 and 2).

As shown in FIG. 1, a second, identically shaped, arrow receptacle 30 is mounted to frame 12 in spaced apart, opposing relationship to receptacle 28. Receptacle 30 is also connected to frame 12 at three points. The cylindrical body of receptacle 30 is connected to upright member 24 at one point, and to cross member 26 at another point. In addition, the bottom portion of receptacle 30 is connected to base member 20 at the third point. Receptacle 30 contains an opening through which a plurality of arrows 31 are inserted for storage in the receptacle. Receptacle 30 is inclined, with an orientation, relative to upright member 24, such that its opening substantially faces to the near side of frame 12 (See FIGS. 1 and 2).

It is an important ergonomic feature to incline the positions of receptacles 28 and 30, because it allows the user to conveniently retrieve arrows without having to step, bend or reach very far from his or her shooting position.

Figure 2:
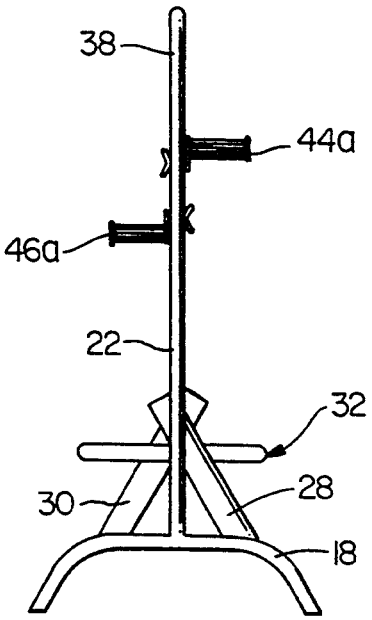
FIG. 2 is a front elevation view of the sport weapon stand of FIG. 1, without the bows and arrows.

As shown in FIGS. 1 and 2, a storage platform 32 is mounted to cross member 26. Platform 32 is positioned, configured and dimensioned to provide a substantially horizontal storage space when frame 12 is supported in an upright position. Platform 32 comprises a tubular frame 34 surrounding an expanded steel, diamond-shaped web 36. In the preferred embodiment, the expanded steel webbing is 3/16ths of an inch thick, and the dimensions of the diamond elements in the web are ¼ inch by ½ inch. Platform 32 provides a convenient place for storing ancillary sport equipment and personal items.

With reference to FIG. 1, it is shown that frame 12 further includes a substantially arch-shaped handle 38. Handle 38 is integrally formed with upright member 22 at one end and with upright member 24 at its other end (See also FIG. 4). Handle 38 is also an important ergonomic feature which facilitates transportation of stand 10 to and from the practice range. Also, the arching shape of handle 38 provides suitable clearance between frame 12 and the sport weapons being supported. Handle 38 does not interfere with manual placement of the weapon onto stand 10 or manual removal of the weapon off of stand 10. Further, the arched shape of handle 38 minimizes potentially destructive contact between the weapon and frame 12 during use of stand 10.

With further reference to FIG. 1, there is shown means for supporting two sport weapons, one on each side of frame 12. A first support means comprises bracket members 44*a* and 44*b* which are pivotally mounted on the near side of frame 12, as shown in FIG. 1. Bracket members 44*a* and 44*b* establish two rest points respectively on the near side of frame 12 for supporting a first archery bow 45, as shown in FIG. 1. A second support means comprises bracket members 46*a* and 46*b* which are pivotally mounted on the far side frame 12. Bracket members 46*a* and 46*b* establish two rest points respectively on the far side of frame 12 for supporting a second archery bow 47, as shown in FIG. 1. The positions of bracket members 44*a*, 44*b*, 46*a* and 46*b* are independently adjustable so that rest points can be independently established at desired support locations to accommodate differently configured and dimensioned sport weapons.

Figure 4:
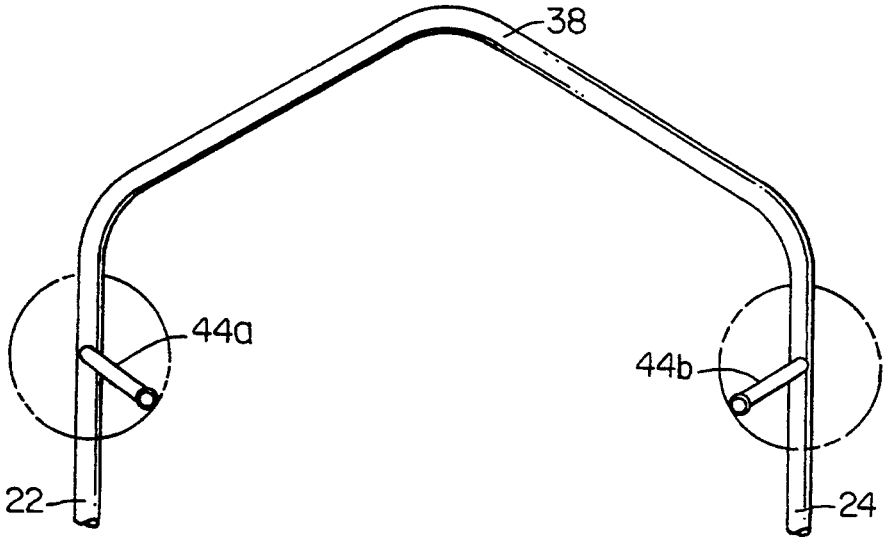
FIG. 4 is a fragmentary side elevation view of the sport weapon stand of the present invention, illustrating the range of positions of a pair of support members.

As shown in FIG. 1, bracket members 44*a* and 44*b* are mounted to upright members 22 and 24 respectively. As illustrated in FIG. 4, bracket members 44*a* and 44*b* are mounted for pivotal rotation about respective pivot points (See also FIG. 5). As shown in FIG. 4, the positions of bracket members 44*a* and 44*b* are adjustable over a 360 degree range. Similarly, bracket members 46*a* and 46*b* are mounted to upright members 22 and 24 respectively, on the opposite side of frame 12, and slightly lower than bracket members 44*a* and 44*b* (See FIGS. 1 and 2). Bracket members 46*a* and 46*b* are also mounted for pivotal rotation about respective pivot points in the same manner as brackets 44*a* and 44*b* (See FIGS. 4 and 5). The preferred arrangement for establishing points of pivotal rotation for bracket members 44*a*, 44*b*, 46*a* and 46*b*, will be described hereinbelow with reference to FIG. 5.

Figure 3A:
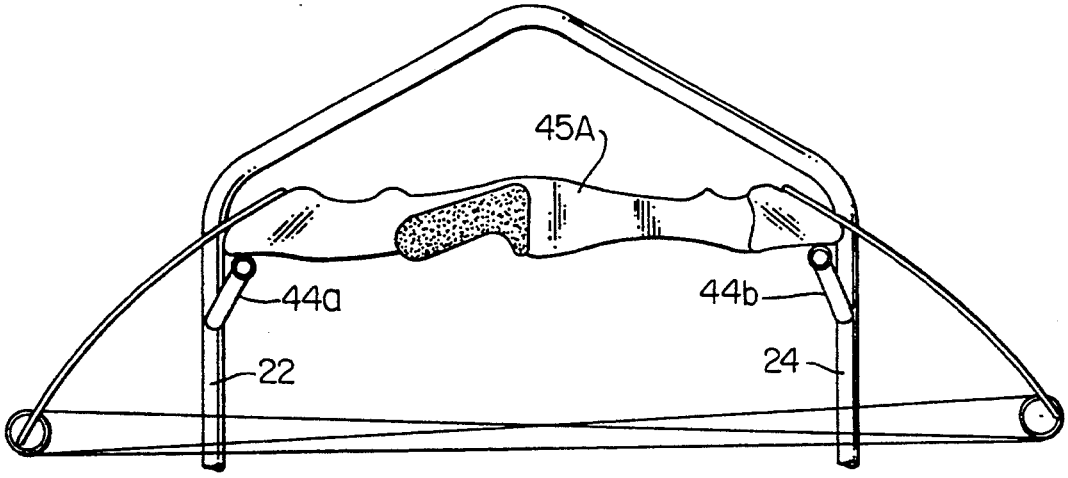
FIG. 3A is a fragmentary side elevation view of the sport weapon stand of the present invention, supporting an archery bow of a first configuration.
Figure 3B:
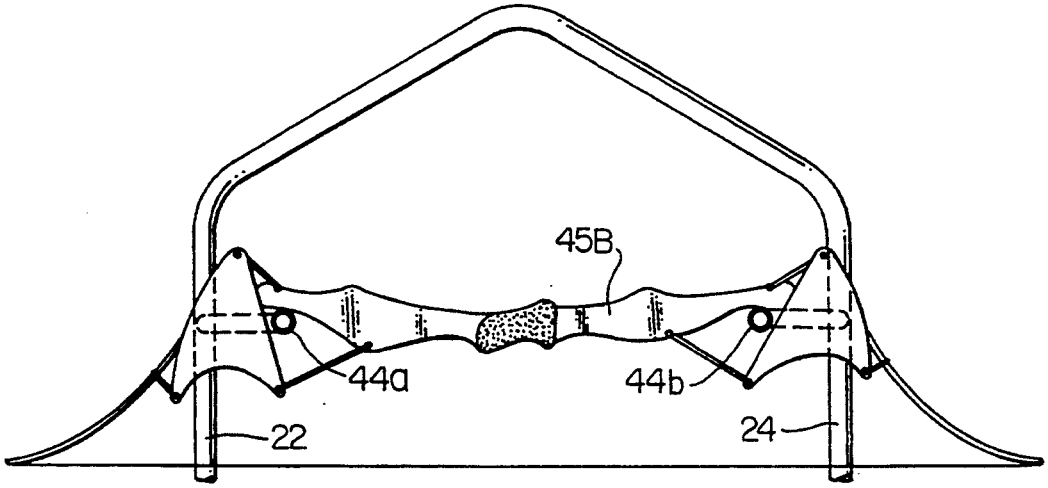
FIG. 3B is a fragmentary side elevation view of the sport weapon stand of the present invention, supporting an archery bow of a second configuration.
Figure 3C:
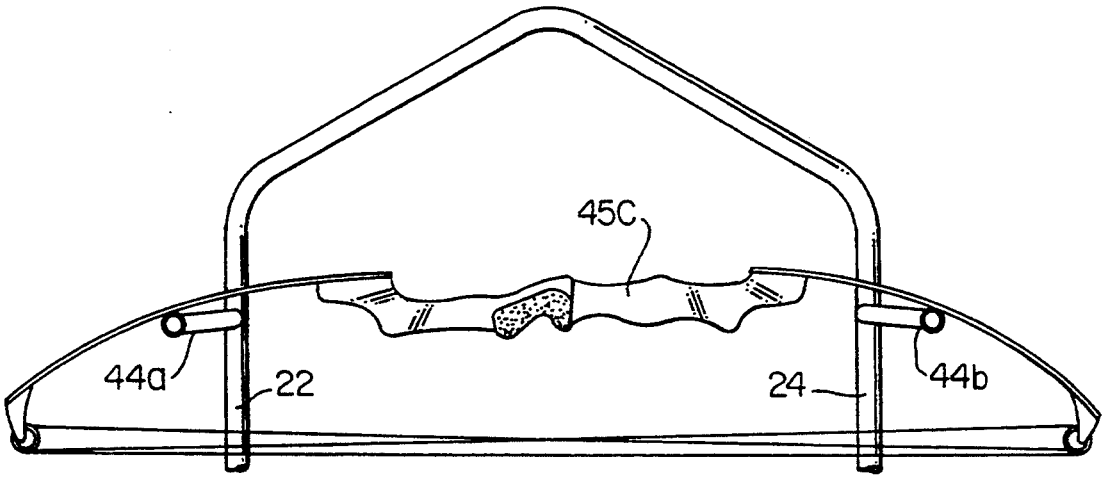
FIG. 3C is a fragmentary side elevation view of the sport weapon stand of the present invention, supporting an archery bow of a third configuration.

Referring now to FIGS. 3A–C, there is illustrated the principal utility of the present invention. FIGS. 3A–C are fragmentary side elevation views of stand 10, showing the function of bracket members 44*a* and 44*b* with respect to three differently configured archery bows. The function of bracket members 44*a* and 44*b*, as illustrated in FIGS. 3A–C, is the same for bracket members 46*a* and 46*b*; accordingly, only one side of stand 10 need be illustrated here.

As shown in FIG. 3A, bracket members 44*a* and 44*b* are secured in position to establish two rest points optimally disposed for supporting an archery bow of a first configuration. In FIG. 3B, bracket members 44*a* and 44*b* are secured in another position to establish two rest points which are optimally disposed for supporting an archery bow of a second configuration. Finally, in FIG. 3C, bracket members 44*a* and 44*b* are secured in yet another position to establish two optimally disposed rest points for supporting an archery bow of a third configuration. FIGS. 3A–C illustrate that bracket members 44*a* and 44*b* can be adjusted to many different positions to accommodate a wide variety of archery bow configurations.

Referring now to FIG. 4, there is shown a fragmentary side elevation view of stand 10, illustrating the range of positions of bracket members 44*a* and 44*b*. Bracket members 46*a* and 46*b* can be adjusted through a similar range of positions on the other side of upright members 22 and 24.

Figure 5:
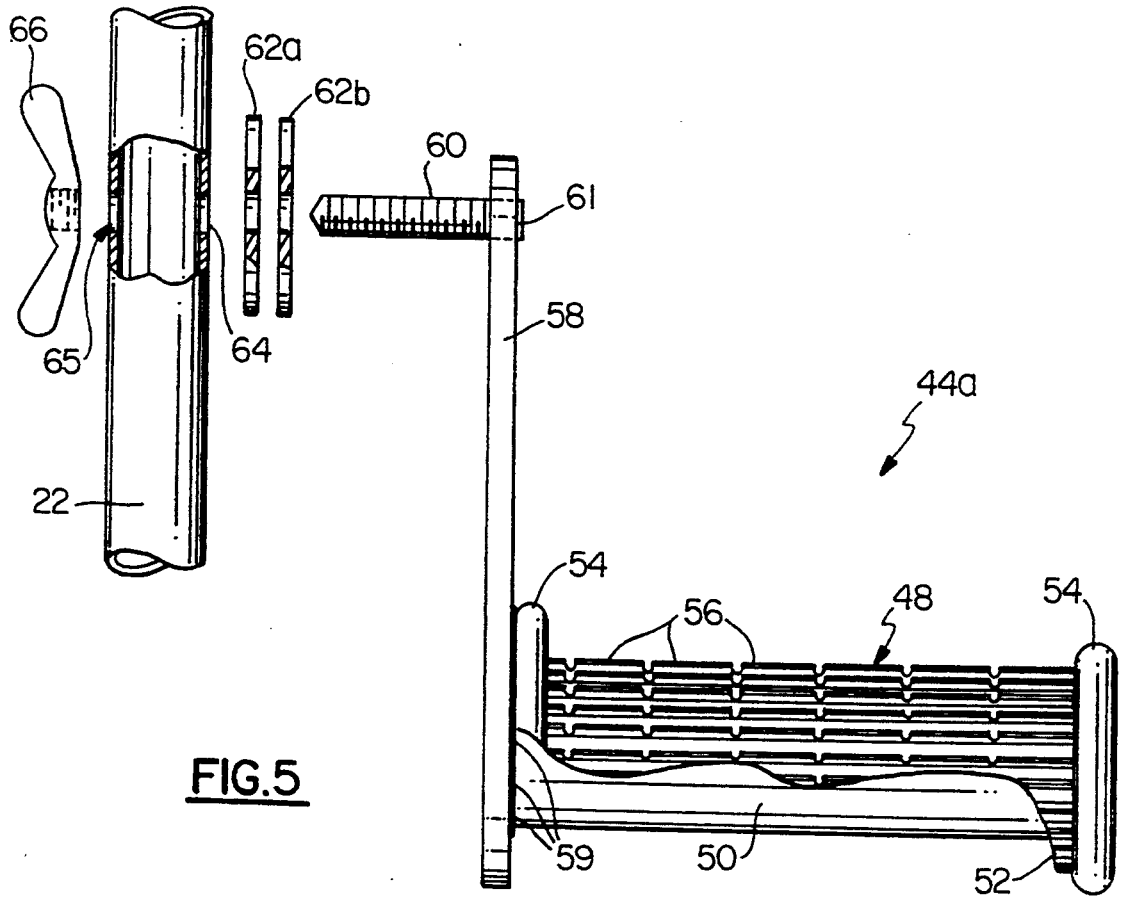
FIG. 5 is an enlarged side elevation view of a bracket member of the present invention, partially cut away, and showing, in an exploded view, the mounting arrangement of the bracket member to the frame of the stand.

Referring to FIG. 5, there is shown an enlarged elevation view of bracket member 44*a*, partially cut away; and showing, in an exploded view, the mounting arrangement of bracket 44*a* to upright member 22. The details of construction of bracket 44*a*, and the method of its mounting to the upright member, are identical for all of the bracket members; accordingly, a description of bracket 44*a* is sufficient to the understanding of the construction and mounting of all bracket members.

As shown in FIG. 5, bracket member 44*a* has a support member 48 comprising a conduit piece 50 surrounded by a handle grip 52. Handle grip 52 includes flange portions 54 and gripping ribs 56. Handle grip 52 may be a bicycle handgrip, such as for a mountain bike. Conduit piece 50 is a standard piece of thin wall, steel conduit, having an outside diameter of ¾ inch. Bracket member 44*a* also comprises a mounting arm 58 which is connected to support member 48 at weld joint 59. In construction, conduit piece 50 is welded directly to mounting arm 58, as evidenced by weld joint 59. Mounting arm 58 is also constructed of thin wall, steel conduit which is flattened into a rectangular bar-shaped member. At one end of the arm 58, a hole is drilled therethrough to accept a threaded rod 60. Threaded rod 60 is approximately 1 ½ inches in length and 5/16ths of an inch in diameter. One end of threaded rod 60 is passed through the hole in arm 58 and welded to arm 58 at weld point 61.

As shown in FIG. 5, a pair of washers 62*a* and 62*b* are employed in the mounting assembly. Washers 62*a* and 62*b* function as spacers and provide clearance between mounting arm 58 and upright member 22. A hole 64 is drilled through upright member 22 to permit pivotal mounting of bracket member 44*a* to upright member 22. A wing nut 66 is sized to clampingly thread onto rod 60. In assembly, washers 62*a* and 62*b* are slipped over rod 60; rod 60 is inserted through hole 64 until its free end protrudes out of hole 64 at an end 65; wing nut 66 is then threaded onto the free end of rod 60 until bracket member 44*a* is tightly secured. This mounting assembly and procedure is identical for each bracket member.

From the foregoing description with reference to FIG. 5, it is understood that the mounting arm of each bracket member is mounted for pivotal rotation about a pivot point. In addition, once mounted, the support member of each bracket member projects outwardly to one side of frame 12 and is perpendicular thereto.

In the preferred embodiment, frame 12 (comprising base member 18, base member 20, upright member 22, upright member 24, cross member 26, and handle 38) is constructed of thin wall, steel cylindrical conduit, having a ½ inch outside diameter. Frame 12 is fabricated by bending a length of conduit into a part consisting of upright member 22, handle 38 and upright member 24. Base members 18 and 20 are formed from shorter, equal lengths of conduit, whose ends are bent downward to form legs and feet (See FIG. 1). Cross member 26 is cut from a stock of conduit to the proper length to fit between upright members 22 and 24.

Cross member 26 is then welded to upright members 22 and 24. Base members 18 and 20 are then welded to the free ends of upright members 22 and 24. Receptacle 28 is then welded to frame 12 at three points—base member 18, upright member 22 and cross member 26. Receptacle 30 is then welded to frame 12, also at three points—base member 20, upright member 24 and cross member 26. Platform 32 is then welded to cross member 26 at two points along tubular frame 34. All welded joints and connections are produced by wire-fed, MIG welding. The completed assembly of frame 12 is then spray painted with a durable, washable enamel paint, such as Centari Enamel Spray Paint.

With respect to the construction of the bracket members, the subassembly, comprising conduit piece 50, mounting arm 58, and rod 60, is also spray painted with a durable, washable enamel paint, such as Centari Enamel Spray Paint.

The overall dimensions of stand 10 is 38 inches at the highest point of handle 38, 20 inches wide between base members 18 and 20, and 22 inches in depth (i.e., the span of base members 18 and 20).

In operation, stand 10 is normally manually positioned on the practice range using handle 38. Bracket members **44*a* and 44*b* and/or bracket members 46*a* and 46*b* are then adjusted to receive and support the particular sport weapon or weapons to be used on the range. Adjustment of bracket members for a particular sport weapon can be accomplished by: (1) fixing one bracket member (e.g., 44*a*) in place (by tightening its associated wing nut); (2) placing one end of the sport weapon on the fixed bracket member at an appropriate location; (3) adjusting the other bracket member (e.g., 44*b***) until it is in an appropriate position for supporting the other end of the sport weapon; and (4) fixing the other bracket member in place (by tightening its associated wing nut).

Alternatively, the wing nuts on each bracket member can be loosened to allow the mounting arms to fall to a vertical position; the sport weapon is then placed on the support members; and then the bracket members are manually adjusted and secured, one at a time, to positions that optimally support the sport weapon.

In an alternative embodiment to stand 10, base 16 may be eliminated and upright members 22 and 24 can be configured with sharp distal ends which are suitable for being driven into a penetrable surface, such as the ground. In such an embodiment, frame 12 is supported not by a base resting on a surface, but by direct anchoring of frame 12 into the surface.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

I claim:

1. A stand for supporting sport weapons, such as bows, firearms and the like, comprising:

a frame configured to be supported upright with respect to a surface; and first support means, mounted to said frame and having a first plurality of rest points situated on one side of said frame, for supporting a first sport weapon on the first plurality of rest points at the one side of said frame, said first support means being adjustable to position said first plurality of rest points at desired support locations.

2. A sport weapon stand as recited in claim 1, further comprising:

second support means, mounted to said frame and having a second plurality of rest points situated on a side of said frame opposite of the one side of said frame, for supporting a second sport weapon on the second plurality of rest points at the opposite side of said frame, said second support means being adjustable to position said second plurality of rest points at desired support locations.

3. A sport weapon stand as recited in claim 2, wherein said frame includes a base, configured to rest on the surface and support said frame in an upright position.

4. A sport weapon stand as recited in claim 2, wherein said first and said second support means each include a pair of brackets members adjustably mounted to said frame, the bracket members of said first support means providing a pair of adjustable rest points for supporting said first weapon, the bracket members of said second support means providing a pair of adjustable rest points for supporting said second weapon.

5. A sport weapon stand as recited in claim 4, wherein the bracket members of said first and said second support means are each mounted to said frame for pivotal rotation about respective pivot points, whereby each rest point in each of said pairs of rest points is independently adjustable.

6. A sport weapon stand as recited in claim 5, wherein said frame includes a base configured to rest on the surface and support said frame in an upright position.

7. A sport weapon stand as recited in claim 6, wherein said frame further includes first and second upright members connected to the base of said frame.

8. A sport weapon stand as recited in claim 7, further comprising first and second receptacles mounted to said frame, each of said receptacles containing an opening, said first receptacle being inclined relative to the first upright member of said frame such that its opening substantially faces to the one side of said frame, said second receptacle being inclined relative to the second upright member of said frame such that its opening substantially faces to the opposite side of said frame.

9. A sport weapon stand as recited in claim 8, further comprising a storage platform mounted to said frame, adjacent to the base of said frame, said platform being positioned, configured and dimensioned to provide a substantially horizontal storage space when said frame is supported in an upright position.

10. A sport weapon stand as recited in claim 9, wherein said frame further includes a handle, said handle being joined with said first upright member at one end and with said second upright member at another end.

11. A stand for supporting sport weapons, such as bows, firearms and the like, comprising:

a frame, including a base which rests substantially flat on a surface, said frame further including first and second upright members connected to said base;

first and second bracket members each having a mounting arm and a support member, the mounting arms of said first and said second bracket members being mounted to the first and the second upright members respectively for pivotal rotation about respective pivot points, the support members of said first and said second bracket members projecting outwardly to one side of said frame and being substantially perpendicular thereto; and third and fourth bracket members each having a mounting arm and a support member, the mounting arms of said third and said fourth bracket members being mounted to the first and the second upright members respectively for pivotal rotation about respective pivot points, the support members of said third and said fourth bracket members projecting outwardly to the opposite side of said frame and being substantially perpendicular thereto;

whereby the support members of said first and said second bracket members provide a first pair of rest points for supporting a first sport weapon on the one side of said frame, the positions of the first pair of rest points being independently adjustable in accordance with the rotation of the mounting arms of said first and said second brackets about their respective pivot points, and the support members of said third and said fourth bracket members provide a second pair of rest points for supporting a second sport weapon on the opposite side of said frame, the positions of the second pair of rest points being independently adjustable in accordance with the rotation of the mounting arms of said third and said fourth brackets about their respective pivot points.

12. A sport weapon stand as recited in claim 11, wherein the base of said frame includes first and second elongated base members, each of said elongated base members having opposing ends turned downward to rest evenly on the surface, the first and the second upright members of said frame being connected to the first and the second base members respectively.

13. A sport weapon stand as recited in claim 12, further comprising first and second receptacles mounted to said frame, each of said receptacles containing an opening, said first receptacle being inclined relative to the first upright member of said frame such that its opening substantially faces to the one side of said frame, said second receptacle being inclined relative to the second upright member of said frame such that its opening substantially faces to the opposite side of said frame.

14. A sport weapon stand as recited in claim 13, wherein said frame further includes a handle, said handle being joined with said first upright member at one end and with said second upright member at another end.

15. A sport weapon stand as recited in claim 14, further comprising a storage platform mounted to said frame, adjacent to the base of said frame, said platform being positioned, configured and dimensioned to provide a substantially horizontal storage space when said frame is supported in an upright position.

16. A sport weapon stand as recited in claim 15, wherein the first and the second elongated base members, the first and the second upright members, and the handle of said frame, are all constructed of tubular steel.

17. A sport weapon stand as recited in claim 16, wherein the support members of said first, said second, said third and said fourth bracket members each have a handle bar grip configuration on its exterior surface to provide a secure rest point for a sport weapon.

18. A method of supporting sport weapons, such as bows, firearms and the like, the method comprising the steps of:

supporting a frame in an upright position;

providing a first plurality of adjustable rest points, coupled to one side of said frame, to support a first sport weapon thereon; and providing a second plurality of adjustable rest points, coupled to a side of said frame opposite of the one side, to support a second sport weapon thereon.

19. A method of supporting sport weapons as recited in claim 18, wherein the rest points of said first and said second plurality of rest points are independently adjustable.

20. A method of supporting sport weapons as recited in claim 19, further comprising the step of independently adjusting the rest points of said first and said second plurality of rest points to accommodate differently configured sport weapons.

* * * * *